United States Patent [19]

Leyendecker et al.

[11] Patent Number: 4,909,150

[45] Date of Patent: Mar. 20, 1990

[54] LINKAGE MECHANISM FOR DRIVING AN OSCILLATING AUXILIARY GRIPPER OF A PRINTING PRESS

[75] Inventors: Hans-Wilhelm Leyendecker, Obertschausen; Paul Abendroth, Offenbach am Main, both of Fed. Rep. of Germany

[73] Assignee: M.A.N. Roland Druckmaschinen AG, Offenbach am Main, Fed. Rep. of Germany

[21] Appl. No.: 65,895

[22] Filed: Jun. 24, 1987

[30] Foreign Application Priority Data

Jun. 6, 1986 [DE] Fed. Rep. of Germany ..... 3621384

[51] Int. Cl.[4] ..... B41F 21/04; B65H 5/14

[52] U.S. Cl. ..... 101/232; 101/246; 271/277

[58] Field of Search ..... 101/246, 232, 409; 271/277, 82

[56] References Cited

U.S. PATENT DOCUMENTS

| | | | |
|---|---|---|---|
| 3,992,993 | 11/1976 | Kuhn et al. | 101/232 X |
| 4,052,055 | 10/1977 | Jiruse et al. | 101/232 X |
| 4,132,403 | 1/1979 | Weisbach et al. | 101/246 X |
| 4,290,595 | 9/1981 | Thunker | 101/246 X |
| 4,295,422 | 10/1981 | Thunker | 101/232 |

*Primary Examiner*—Clifford D. Crowder

*Attorney, Agent, or Firm*—Leydig, Voit & Mayer

[57] ABSTRACT

A device for driving an oscillating auxiliary gripper of a printing press includes a driven shaft having an eccentric portion thereon, the driven shaft being rotatably mounted on the side upright of the press and on the eccentric portion of which a cam-actuated auxiliary gripper shaft is rotatably mounted for oscillation thereon. A driven gear is rigidly secured to the driven shaft and meshes permanently with a drive gear that rotates with the impression cylinder to provide positively cooperating drive elements for introducing the desired additional oscillating motion upon the continuous orbital movement of the auxiliary gripper shaft. To this end, a trio of cams secured to the upright act on the auxiliary gripper shaft by way of cam followers disposed on a link rod rotatably mounted on the auxiliary gripper shaft and a drag lever is pivotally connected to the link rod by way of a pivot connection and is also pivotally and eccentrically connected to the driven gear by way of a pivoted connection therein for oscillating the auxiliary gripper shaft on the eccentric portion of the rotating driven shaft.

3 Claims, 2 Drawing Sheets

LINKAGE MECHANISM FOR DRIVING AN OSCILLATING AUXILIARY GRIPPER OF A PRINTING PRESS

FIELD OF THE INVENTION

The present invention relates generally to a device for driving an oscillating auxiliary gripper of a printing press and more particularly concerns a linkage mechanism for driving such a device.

BACKGROUND OF THE INVENTION

Devices for driving an oscillating auxiliary gripper of a printing press are widely known in the art. One example of such a device is disclosed in DE-PS 2,220,343. A disadvantage with this type of device is that non-positively cooperating drive elements are used to control the movement of the auxiliary gripper shaft. In operation, a cam actuated in association with a spring presses a lever arm continuously onto a roller. Consequently, the non-positive elements are stressed very severely by the considerable mass forces which arise because of the high angular velocities and accelerations of the auxiliary gripper.

Another disadvantage is that the motion of the auxiliary gripper shaft calls for the use of input and output shafts whose center-axes are far apart from one another, leading to long linkages and, therefore, high mass forces. This consideration also applies to a camless drive of an oscillating auxiliary gripper such as is disclosed by EPA 0006402.

Other disadvantages are that the auxiliary gripper of such devices cannot be fully preassembled, and final assembly and replaceability are difficult as well.

OBJECTS AND SUMMARY OF THE INVENTION

Accordingly, it is the primary aim of the invention to provide a device of the kind hereinbefore set out with positively cooperating drive elements and a coaxial arrangement of the input and output shafts for providing the additional motion superimposed on the continuous rotation of the lifting eccentric of the auxiliary gripper.

Pursuant to the invention, there is provided a device for driving an oscillating auxiliary gripper of a printing press having an eccentric shaft rotatably mounted in the side upright of the press and on which a cam-actuated auxiliary gripper shaft is mounted for rotation with a driven gear rigidly secured to the eccentric shaft and meshing permanently with a drive gear that rotates with the impression cylinder of the press, characterized in that the eccentric shaft is rotatably mounted in a casing shell of said side upright, a trio of cams secured to said upright act on the auxiliary gripper shaft by way of cam followers disposed on a link rod rotatably mounted on the auxiliary gripper shaft, and a drag lever is pivotally connected to the link rod by way of a pivot connection and is pivotally and eccentrically connected to the driven gear by way of a pivoted connection therein. In alternate embodiments, the trio of cams may comprise three external cams or two external cams and one internal cam with appropriate cam followers.

The principal advantages of the invention are that mass forces are considerably minimized and preassembly, final assembly and replaceability of the device are substantially improved.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
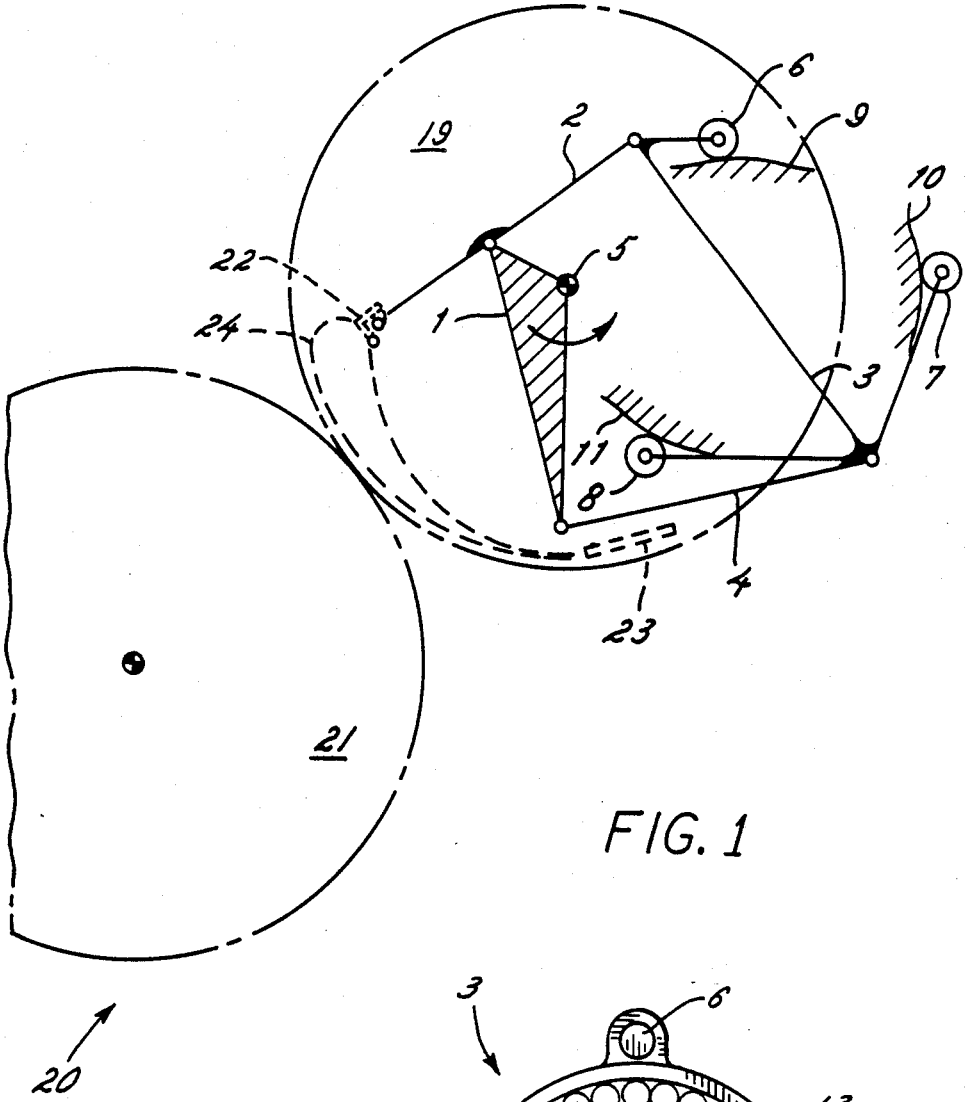
FIG. 1 is a diagram illustrating the motions of the linkage mechanism of the present device.

Turning now to the drawings, FIG. 1 is a schematic diagram showing the motions of a four-member drive line comprising a drive member 1, an auxiliary gripper plane 2, a link rod 3 and a drag lever 4. The elements 1–4 produce motion 24 of the gripper 22 at the end of the plane 2 by the drive member 1, which is mounted in a side upright 5 of a printing press, being driven at a constant angular velocity and by the drag lever 4 pulling cam rollers 6–8 on the rod 3 over a trio of associated cams 9–11 screwed fast in the press upright 5. The cams 9–11 are so devised as to produce the required motion 24 of the gripper 22 at the end of the plane 2.

Figure 4:
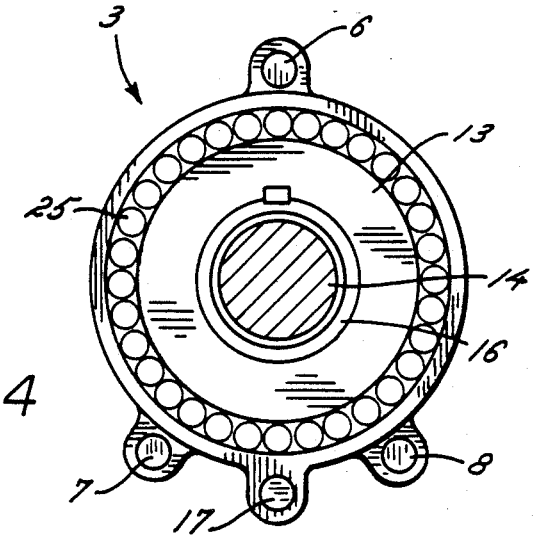
FIG. 4 is a diagrammatic end view of the link rod of the device.
Figure 3:
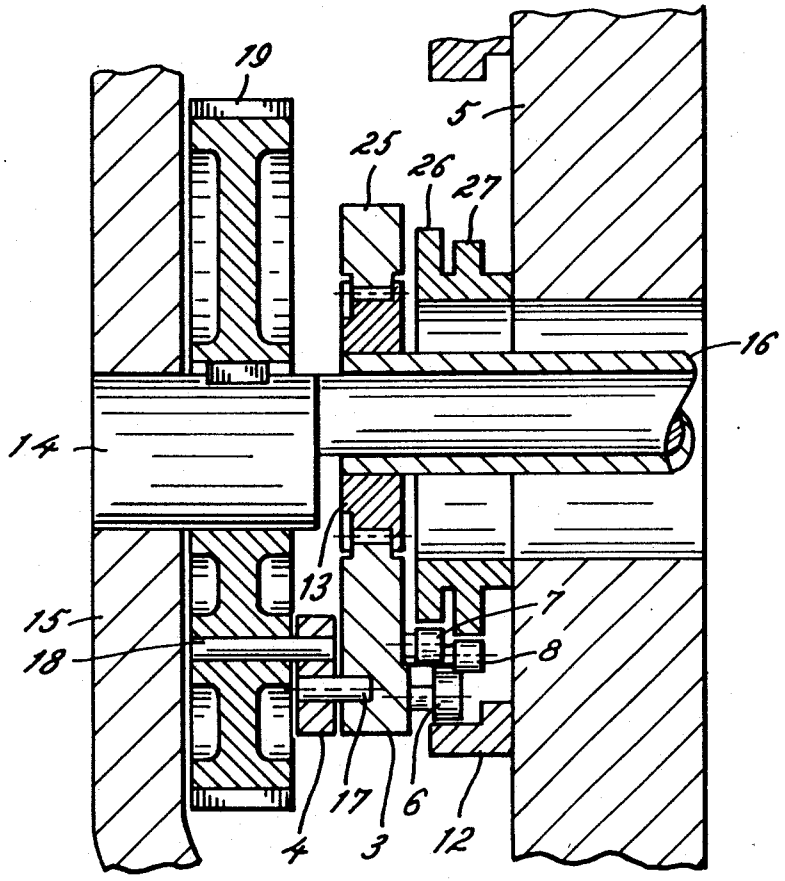
FIG. 3 is a section through another embodiment of the auxiliary drive.
Figure 2:
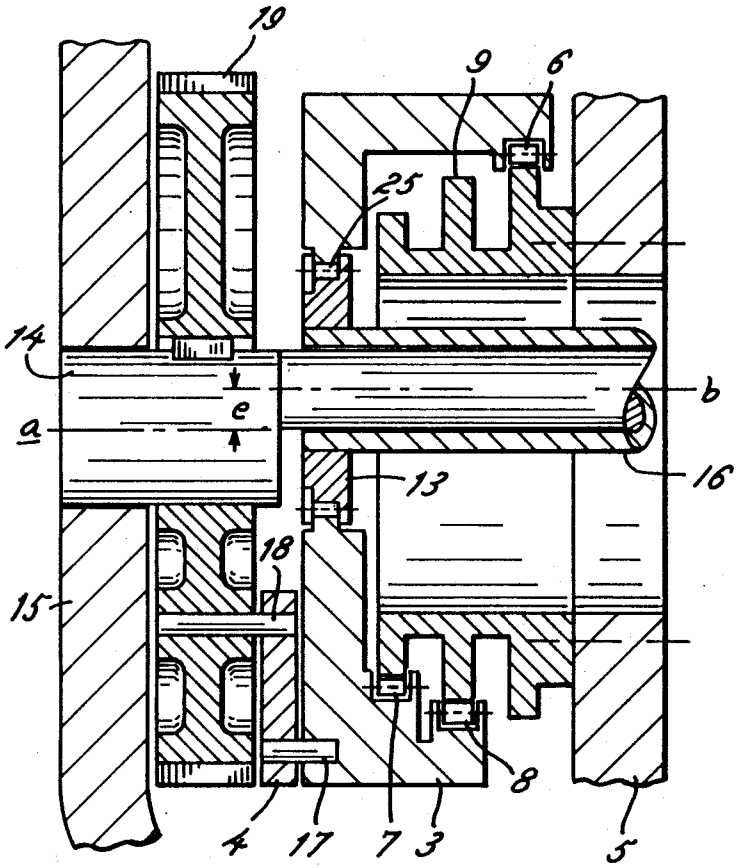
FIG. 2 is a section through one embodiment of the auxiliary gripper drive.

FIGS. 2–4 show various embodiments which differ from one another in the arrangement of the trio of cams. Thus, FIG. 2 shows one possible construction using three cams 9–11 with outside cam followers and FIG. 3 shows a construction using two cams 26, 27 having outside followers and one cam 12 having inside followers. The latter construction has the advantage of lower overall height. For simplification, like elements of the two embodiments have the same reference.

In both embodiments, an auxiliary gripper shaft 16 is rotatably mounted on an eccentric shaft 14 which is in turn rotatably mounted in a casing shell 15 on the side upright 5 of a printing press. The link rod 3 is mounted for rotation with the interposition of fifteen rollers 25 on a bearing 13 rigidly connected to the shaft 16. The rod 3 is connected by way of a pivot connection 17 to the relatively short drag lever 4 and the same is connected pivotably and eccentrically in a gear 19 by way of a pivoted connection 18. The gear 19 and eccentric shaft 14 form the drive member 1, their center-axes being coaxial of one another. The gear 19 meshes permanently with a drive gear 21 co-rotating with impression cylinder 20 of the press (see FIG. 1).

The motion 24 of the shaft 16 is produced by an orbiting motion—the radius of the orbit being determined by the amount of eccentricity e—i.e., the distance between the center-axis of the gear 19 from the center-axis of the shaft 16—being superimposed upon a general movement of the rod 3 controlled by way of the stationary cam trio 9–11 in one embodiment and the stationary cam trio 12, 26, 27 in another embodiment, so that an additional pivoting motion is imparted to the shaft 16.

The motion 24 which the shaft 16 is required to make is shown in dash lines in FIG. 1 as a movement of the gripper 22 at the end of the plane 2. The timing provided by the driver linkage of the present invention ensures that grippers 22 are stationary at transfer of a sheet from a support table or horse 23, that the sheet is transferred to the grippers (not shown) of the impression cylinder 20 at the same speed and that the return movement, in which the grippers 22 move away from the cylinder 20 to their normal position and gradually return to their initial position for the transfer of a new sheet, is terminated.

We claim as our invention:

1. A device for driving an oscillating auxiliary gripper of a printing press having a driven shaft rotatably mounted on the side upright of the press, said driven shaft having an eccentric portion on which a cam-actuated auxiliary gripper shaft is rotatably mounted for oscillation thereon, a driven gear rigidly secured to said driven shaft and meshing permanently with a drive gear that rotates with the impression cylinder of the press, characterized in that said driven shaft is rotatably mounted in a casing shell secured to said side upright, a trio of cams secured to said upright, means including a link rod rotatably mounted on the auxiliary gripper shaft, said link rod means carrying a plurality of cam followers for respectively engaging said trio of cams, and a drag lever pivotally connected to said link rod means by way of a pivot connection and also pivotally and eccentrically connected to said driven gear by way of a pivoted connection therein for oscillating said auxiliary gripper shaft on the eccentric portion of said rotating driven shaft.

2. A device according to claim 1, characterized in that the trio of three cams is provided with external cam followers.

3. A device according to claim 1, characterized in that the trio of three cams comprises two cams with external cam followers and one cam with internal cam followers.

* * * * *